US009475067B2

(12) United States Patent
Bai et al.

(10) Patent No.: US 9,475,067 B2
(45) Date of Patent: Oct. 25, 2016

(54) CHALCOPYRITE ORE BENEFICIATION PROCESS AND METHOD

(71) Applicant: North China University of Science and Technology, Tangshan, Hebei (CN)

(72) Inventors: Limei Bai, Hebei (CN); Yuexin Han, Liaoning (CN); Zhitao Yuan, Liaoning (CN); Yuxin Ma, Liaoning (CN); Guozhen Liu, Hebei (CN); Meng Li, Hebei (CN); Libing Zhao, Hebei (CN); Fusheng Niu, Hebei (CN); Jinxia Zhang, Hebei (CN)

(73) Assignee: NORTH CHINA UNIVERSITY OF SCIENCE AND TECHNOLOGY, Tangshan (CN)

( * ) Notice: Subject to any disclaimer, the term of this patent is extended or adjusted under 35 U.S.C. 154(b) by 0 days.

(21) Appl. No.: 14/907,578

(22) PCT Filed: Nov. 26, 2013

(86) PCT No.: PCT/CN2013/087823

§ 371 (c)(1),
(2) Date: Jan. 26, 2016

(87) PCT Pub. No.: WO2015/077911

PCT Pub. Date: Jun. 4, 2015

(65) Prior Publication Data

US 2016/0158767 A1 Jun. 9, 2016

(51) Int. Cl.
*B02C 23/14* (2006.01)
*B03D 1/02* (2006.01)

(52) U.S. Cl.
CPC ..... *B03D 1/02* (2013.01); *B02C 23/14* (2013.01); *B03D 2203/02* (2013.01)

(58) Field of Classification Search
CPC ..... B02C 23/14; B03D 1/02; B03D 2203/02
USPC ..... 241/20, 24.1, 24.13, 29
See application file for complete search history.

(56) References Cited

FOREIGN PATENT DOCUMENTS

| | | |
|---|---|---|
| CN | 101254484 A | 9/2008 |
| CN | 101450335 A | 6/2009 |
| CN | 101972705 | 2/2011 |
| CN | 101985111 A | 3/2011 |

OTHER PUBLICATIONS

International Search Report and Written Opinion of ISA of PCT/CN2013/087823 issued on Jul. 11, 2014 (in Chinese).
English Translation of International Search Report and Written Opinion of ISA of PCT/CN2013/087823 issued on Jul. 11, 2014.

*Primary Examiner* — Faye Francis

(57) ABSTRACT

The present invention relates to a mineral processing technology and method for refractory chalcopyrite ores, particularly to a mineral processing technology and method for the separation of chalcopyrite from multiple natural types of copper ores containing chalcopyrite, pyrrhotite, talc and serpentine, which belongs to the technical field of mineral processing. It's characterized by: conducting a two-stage grinding on the chalcopyrite ore, with each grinding stage followed by size grading, and treating ores in different size fractions separately, wherein coarse-grain ores are separated in the presence of xanthate, with calcium oxide and CMC controlling the pH and acting as depressor respectively, while fine-grained ores are subjected to rougher in the presence of kerosene, and subsequently subjected to cleaner in the presence of xanthate.

4 Claims, 1 Drawing Sheet

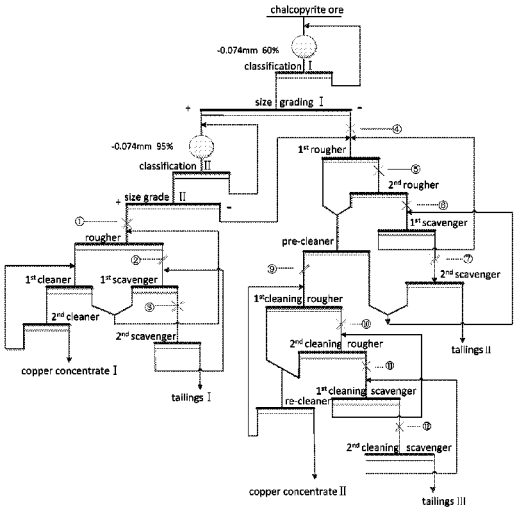

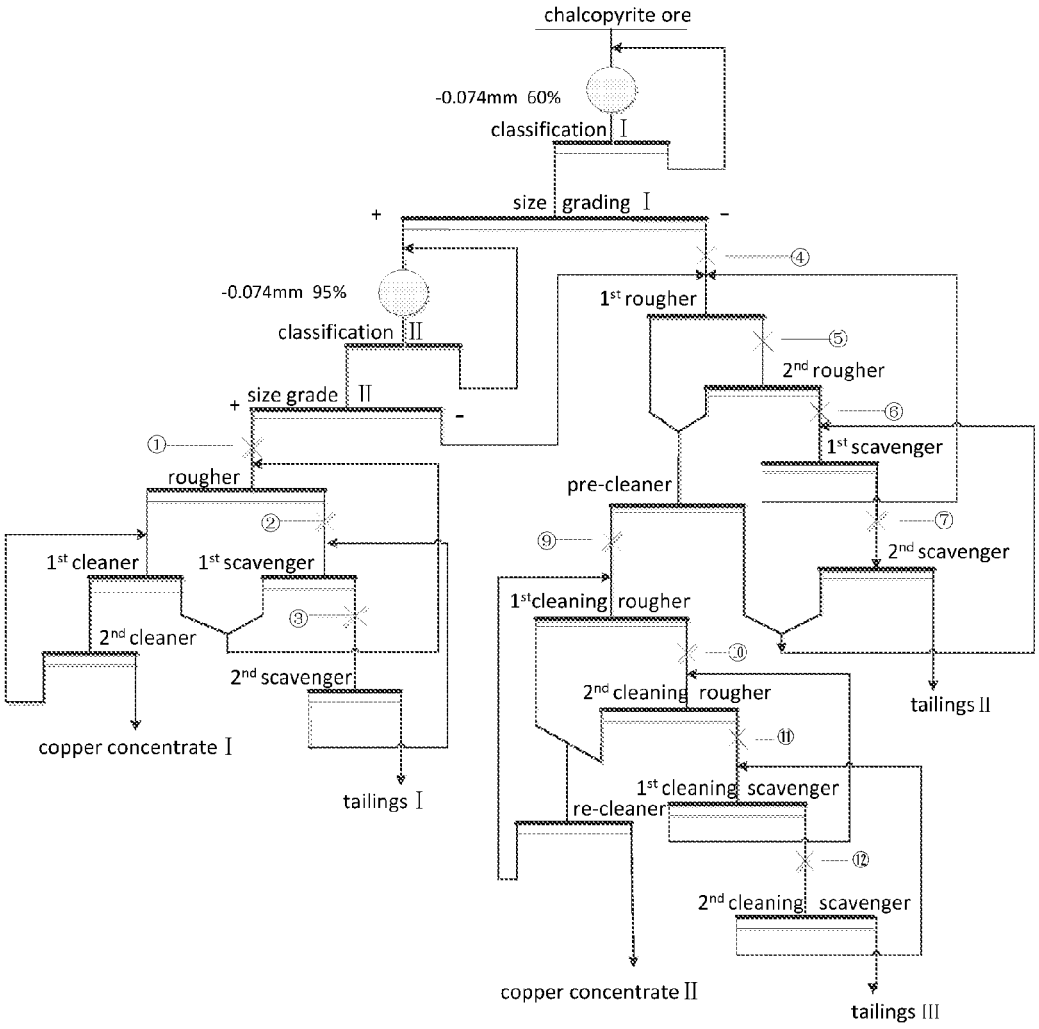
chalcopyrite ore
-0.074mm 60%
classification I
size grading I
+
-
④
-0.074mm 95%
classification II
1st rougher
⑤
2nd rougher
+ size grade II
-
⑥
1st scavenger
①
rougher
pre-cleaner
②
⑦
⑨
2nd scavenger
1st cleaner
1st scavenger
1st cleaning rougher
③
2nd cleaner
⑩
2nd scavenger
2nd cleaning rougher
tailings II
⑪
copper concentrate I
1st cleaning scavenger
tailings I
re-cleaner
⑫
2nd cleaning scavenger
copper concentrate II
tailings III

CHALCOPYRITE ORE BENEFICIATION PROCESS AND METHOD

TECHNICAL FIELD

The present invention relates to the field of mineral processing technology, and particularly to a method and process for separating chalcopyrite from talc, pyrite and pyrrhotite by flotation.

BACKGROUND OF THE INVENTION

Copper is an extremely important metal material in the national economic construction. With the rapid development of national economy, the copper resources which are easy to separate are getting increasingly scarce, more and more attention has been paid to the development and utilization of refractory copper resources. With the aim of realizing the efficient development and utilization of refractory chalcopyrite resources, extensive studies have been conducted by a number of research units and institutes. CN Pat. App. No. 200710180591.5 discloses a method for flotation separation of copper-sulfur, in which copper-sulfur separation of bulk concentrate is achieved at a pH of between 12.5 and 13, with the addition of combined depressor including calcium oxide, sodium sulfate and sodium cyanide. However, sodium cyanide is an extremely toxic reagent, the application of which will be detrimental to the sequential tailing treatment and the environment. CN Pat. App. No. 201010539277.3 discloses a method for copper-sulfur separations, in which sodium silicate or sodium sulfide acting as depressor is employed to accomplish the separation of copper from sulfur. CN Pat. App. No. 200710035482.4 discloses an efficient and environmentally friendly method for the separation of complex sulfide ores. Sulfide flotation is performed, one or more of oxalic acid, sodium carbonate, ammonium bicarbonate, ammonium sulfate, ammonium bisulfate and ferrous sulfate acting as activator, yellow collector (xanthate), black collector (aerofloat), white collector (thiocarbanilide) and thionocarbamate acting as collector of sulfide ore, and BC acting as frother are added and agitated to disperse uniformly, in which case sulfide concentrate is recovered. Such processes are performed to achieve copper-sulfur separations on sulfide concentrate generally by using combined depressor or activator, and flotation reagents with high degree of selectivity.

Some of refractory copper ores have multiple natural types, such as chalcopyrite ore containing pyrrhotite, chalcopyrite ore containing pyrrhotite, talc and serpentine, chalcopyrite ore containing pyrite, copper skarn and so on. The chalcopyrite ore containing pyrrhotite, talc, and serpentine, such as copper ore in Dongguashan is one kind of typical refractory ore. Based on variable characteristics of Dongguashan copper ores, there are alternative separation processes. For chalcopyrite ores which are free of pyrrhotite, talc and serpentine, they are treated using combined depressor and highly effective collector in the presence of xanthate, in which case sulfide ores are floated off to separate copper from other sulfide minerals. While chalcopyrite ores containing pyrrhotite, talc and serpentine are treated using combined depressor and highly effective collector to realize copper-sulfur separation. The processes have three disadvantages as follows: Firstly, although online analysis and inspection system are adopted in the flotation circuits, there is a certain lag between the changes occurred in differential separation processes, additionally, the separation processes often fail to reach steady state in time, causing it hard to obtain a steady metallurgical performance, both of which lead to lower separation efficiency and greater copper losses especially when changes in ores type are frequent. Secondly, talc exhibits excellent floatability, therefore increasing talc pre-flotation can effectively reduce the content of silicon and magnesium in the copper concentrate, whereas chalcopyrite is also readily floatable, and a portion of chalcopyrite is floated into the talc concentrate during the talc pre-flotation, which causes copper losses and lowers the recovery of chalcopyrite. Thirdly, even though the highly selective collector or combined depressor is employed, the metallurgical performance is still not very satisfactory, and the cost of flotation reagents is remarkably high.

SUMMARY OF THE INVENTION

The present invention provides a mineral processing technology and method for efficient separation of refractory chalcopyrite ores in view of the multiple natural types of copper ores containing chalcopyrite, pyrrhotite, talc and serpentine. Specific methods are carried out according to the following steps:

(1) performing a primary grinding and classification I on the crushed chalcopyrite ore, wherein 60% of the product size of the primary classification I is −0.074 mm; carrying out a first size grading I on the product (overflows) obtained from the primary classification I, wherein the cut-point of the size grading I is 0.04 mm; conducting a second grinding and classification II on the mineral which is coarser than 0.04 mm, wherein 95% of the product size of the classification II is −0.074 mm; thereafter conducting the secondary size grading II on the product (underflows) obtained from the classification II, wherein the cut-point of the size grading II is 0.04 mm;

(2) performing the coarse-grain flotation circuits on the coarse-grain product which is coarser than 0.04 mm obtained from the size grading II; undertaking a one-stage rougher (flotation) on the coarse-grain product from the size grading II, in which calcium oxide is used to adjust the pH value, sodium carboxymethyl cellulose (CMC) used as depressor, xanthate used as collector and pine camphor oil used as frother are added to the rougher cell sequentially; conducting a two-stage scavenger (flotation) on the rougher tailings, wherein the types of reagents used in the two-stage scavenger are the same as those used in the rougher; recycling the first scavenger concentrate back to the rougher feed; performing a second scavenger on the first scavenger tailings, wherein the second scavenger tailings are the final tailings I; conducting a two-stage cleaner (flotation) on the rougher concentrate, wherein the first cleaner tailings are recirculated to the rougher feed and the first cleaner concentrate is reported to the second cleaner feed, and wherein the second cleaner tailings are recirculated to the first cleaner feed and the second cleaner concentrate is the copper concentrate I;

(3) carrying out fine-grain flotation circuits on the fine-grain product which is smaller than 0.04 mm obtained from the size grading I and the size grading II; firstly, conducting a two-stage rougher on the fine-grain product, wherein kerosene or diesel used as collector and pine camphor oil used as frother are added to the two rougher cells sequentially; performing a two-stage scavenger on the second rougher tailings, wherein kerosene or diesel oil used as collector and pine camphor oil used as frother are also added to the two scavenger cells sequentially; returning the first scavenger concentrate to the first rougher feed; recycling the second scavenger concentrate to the first scavenger feed, wherein the second scavenger tailings are the final tailings II; undertaking the pre-cleaner on the concentrates from the two-stage rougher in the absence of any reagents; subsequently recirculating the pre-cleaner tailings to the first scavenger feed; conducting a two-stage cleaning rougher on the pre-cleaner concentrate, in which calcium oxide is used to adjust the pH value, sodium carboxymethyl cellulose(CMC) used as depressor, xanthate used as collector and pine camphor oil used as frother are added to the two cleaning rougher cells sequentially; conducting a second cleaning rougher on the first cleaning rougher tailings, and conducting a two-stage cleaning scavenger on the second cleaning rougher tailings, wherein the types of reagents used in the two-stage cleaning scavenger are the same as those used in the cleaning rougher cells; performing a first cleaning scavenger on the second cleaning rougher tailings; recirculating the first cleaning scavenger concentrate to the second cleaning rougher feed and recirculating the second cleaning scavenger concentrate to the first cleaning scavenger feed, wherein the second cleaning scavenger tailings are final tailings III; performing a re-cleaner on the concentrates from the two-stage cleaning rougher; and recirculating the re-cleaner tailings to the first cleaning rougher feed, wherein the re-cleaner concentrate is the copper concentrate II.

According to the above method in step (2), the pH value in the rougher is between 11.4 and 11.6, and between 65 and 75 $g \cdot t^{-1}$ of depressor, between 60 and 90 $g \cdot t^{-1}$ of collector and between 20 and 25 $g \cdot t^{-1}$ of frother are used in the rougher. Whereas the pH value in the scavenger is also between 11.4 and 11.6, and the amounts of the depressor, collector and frother in the first scavenger are half of those in the rougher respectively, and the amounts of the depressor, collector and frother in the second scavenger are one third of those in the first rougher respectively.

According to the above method in step (3), between 35 and 40 $g \cdot t^{-1}$ of collector and between 6 and 10 $g \cdot t^{-1}$ of frother are used in the first rougher, whereas the amounts of the collector and frother in the second rougher are the same as those in the first rougher respectively. The amounts of the collector and frother in the first scavenger are half of those in the first rougher respectively. The amounts of the collector and frother in the second scavenger are one third of those in the rougher respectively.

According to the above method in step (3), the pH value in the first cleaning rougher is between 11.8 and 12.0, and between 50 and 70 g·t−1 of depressor, between 50 and 75 g·t−1 of collector and between 18 and 24 g·t−1 of frother are used in the first cleaning rougher, whereas the pH values in the second cleaning rougher, and the first and second cleaning scavengers are all between 11.8 and 12.0. The pH values in two-stage scavengers are also between 11.8 and 12.0, wherein the amounts of said depressor, collector and frother used in the first cleaning scavenger are half of those in the first cleaning rougher respectively, and the amounts of said depressor and frother used in the second cleaning scavenger are one third of those in the first cleaning rougher respectively.

In the present invention which adopts the above technical scheme, size grading not only reduces the influence of talc, pyrite and pyrrhotite on chalcopyrite ore containing pyrrhotite, talc and serpentine, but also reduces the influence of fine size fraction mineral on coarse mineral, and reduces the consumption of reagents. In the flotation of coarse chalcopyrite ore containing pyrrhotite, talc and serpentine, CMC is added to depress talc, and calcium oxide is used to control the pH and to depress pyrite and pyrrhotite. Without any influence from the fine particles, high grade copper concentrate can be obtained consequently. The separation of fine-sized chalcopyrite from pyrite, pyrrhotite and talc remains an issue. Merely using CMC to depress talc, calcium oxide to control the pH and to depress pyrite and pyrrhotite, and xanthate to collect chalcopyrite, the metallurgical performance of chalcopyrite is not efficient at all. In order to achieve effective selective separation of fine chalcopyrite, preconcentration is conducted using hydrocarbon oil collector such as kerosene or diesel oil on the rougher concentrate to separate chalcopyrite from pyrite and pyrrhotite, in which case the influence of pyrite and pyrrhotite on the flotation process is reduced, thereafter conducting cleaner on the preconcentration concentrate using CMC to depress talc and calcium oxide to control the pH and depress pyrite and pyrrhotite. In the present invention, ores are divided into fine size fraction and coarse size fraction by means of size grading and are processed separately. Flotation separation of such refractory chalcopyrite ore can be achieved by treating ores with conventional sulfide collectors and depressors, and treating ores in fine size fraction with kerosene and diesel oil, employed as collector either alone or in combination with each other. Therefore, the cost of flotation reagents is cut down greatly. In the case that the chalcopyrite ore is free of pyrrhotite, talc and serpentine, this process will not influence the final metallurgical performance. Therefore, the present process can realize the flotation separation of chalcopyrite from multiple natural types of chalcopyrite ores containing pyrrhotite, talc and serpentine.

BRIEF DESCRIPTION OF THE DRAWING

FIG. 1 shows the technical flow diagram of the present invention.

DETAILED DESCRIPTION

The present invention will now be described, by way of examples, with reference to the accompanying FIG. 1.

EXAMPLE 1

Primary materials of the present invention: copper ore from Dongguashan, calcium oxide, CMC, sodium ethylxanthate, kerosere, pine camphor oil.

The chalcopyrite primary ore used in the present invention mainly contained 0.94% Cu, 23.20% TFe, 14.38% S, 3.9% MgO, 28.03% $SiO_2$, and the principal mineralogical composition were sulfide minerals (including 24.75% pyrhotite, 10.71% pyrite, 3.07% chalcopyrite, 0.01% galena, etc), 8.07% iron oxide (mainly comprising magnetite), and gangue mineral (consisting predominantly of 7.49% quartz, 4.34% feldspar, 1.5% talc and 6.22% carbonate, etc). The dissemination of chalcopyrite and pyrrhotite was relatively fine in the ore, whereas pyrite was mainly disseminated in the coarse fraction, and the relationship amongst the dissemination of these three minerals was very complex, so that optimum liberation was seldom achieved, which has significant impact on grinding stage and the sequential floating circuits.

Step One: Size Grading

The crushed chalcopyrite ore was subjected to a primary grinding and classification I, wherein 60% of the product size of the primary classification I was −0.074 mm. Then, the product (overflows) obtained from the classification I was subjected to a primary size grading I, wherein the cut-point of size grading I was 0.04 mm. Thereafter, mineral larger than 0.04 mm was subjected to a secondary grinding and classification II, wherein 95% of the product size of the classification II was −0.074 mm. After that, the product (underflows) obtained from the classification II was subjected to a secondary size grading II, wherein the cut-point size of the size grading II was 0.04 mm.

Step Two: Coarse-Grain Flotation Circuits

The coarse-grain product which was larger than 0.04 mm produced from the size grading II was subjected to coarse-grain flotation circuits. A one-stage rougher was conducted on the coarse-grain product, in which calcium oxide was used to adjust the pH value. Sodium carboxymethyl cellulose used as depressor, xanthate and pine camphor oil were added to the rougher cell sequentially and the flotation time was 5 min. Then, a first scavenger was conducted on the rougher underflows, wherein calcium oxide was employed to adjust the pH value and the flotation time was the same as the rougher time. Then, the first scavenger concentrate was recycled back to the rougher feed. A second scavenger was conducted on the first scavenger underflows, wherein calcium oxide was employed to adjust the pH value and the flotation time was the same as the rougher time. Then, the second scavenger concentrate was recycled back to the first scavenger feed. Thereafter, a first cleaner was conducted on the rougher concentrate and the flotation time was 3 min. Then, the first cleaner tailings were returned back to the rougher feed, and a second cleaner was conducted on the first cleaner concentrate, wherein the flotation time was 3 min. At last, the second cleaner tailings were recirculated to the first cleaner feed. The second cleaner concentrate was the copper concentrate I, and the second scavenger tailings were the final tailings I.

Step Three: Fine-Grain Flotation Circuits

The fine-grain product which was smaller than 0.04 mm obtained from the size grading I and the size grading II was subjected to fine-grain flotation circuits. A two-stage rougher was conducted on the fine-grain product, in which kerosene used as collector and pine camphor oil used as frother were added to the two-stage rougher cells sequentially. A two-stage scavenger was conducted on the second rougher tailings, in which kerosene used as collector and pine camphor oil used as frother were added to the two-stage scavenger cells sequentially. The first scavenger concentrate was returned to the first rougher feed, and the second scavenger concentrate was recycled to the first scavenger feed. The second scavenger tailings were the final tailings II. The concentrates from two-stage rougher were subjected to a pre-cleaner in the cleaning operation, in the absence of reagents. The pre-cleaner tailings were recirculated to the first scavenger feed. A two-stage cleaning rougher was conducted on the pre-cleaner concentrate, in which calcium oxide was used to adjust the pH value. Sodium carboxymethyl cellulose (CMC) used as depressor, xanthate used as collector and pine camphor oil used as frother were added to the two-stage cleaning rougher cells sequentially. A second cleaning rougher was conducted on the first cleaning rougher tailings, and a two-stage cleaning scavenger was conducted on the second cleaning rougher tailings. The types of reagents used in the two-stage cleaning scavenger are the same as those used in the cleaning rougher cells. A first cleaning scavenger was conducted on the second cleaning rougher tailings. The first cleaning scavenger concentrate was recirculated to the second cleaning rougher feed, and the second cleaning rougher concentrate was recirculated to the first cleaning scavenger feed. The second cleaning scavenger tailings were the final tailings III. A re-cleaner was performed on the concentrates from the two-stage cleaning rougher. The re-cleaner tailings were recirculated to the first cleaning rougher feed. The re-cleaner concentrate was the copper concentrate II.

The reagent amounts and mixing time of each operation are presented in Table 1.

TABLE 1

| | CaO | | CMC | | Xanthate | | Pine camphor oil | |
|---|---|---|---|---|---|---|---|---|
| Numerical order | pH value | mixing time (min) | amount ($g \cdot t^{-1}$) | mixing time (min) | amount ($g \cdot t^{-1}$) | mixing time (min) | amount ($g \cdot t^{-1}$) | mixing time (min) |
| 1 | 11.5 | 2 | 65 | 2 | 65 | 2 | 20 | 1 |
| 2 | 11.5 | 2 | 32 | 2 | 32 | 2 | 10 | 1 |
| 3 | 11.5 | 2 | 21 | 2 | 21 | 2 | 7 | 1 |
| 9 | 11.8 | 2 | 50 | 2 | 50 | 2 | 18 | 1 |
| 10 | 12.0 | 2 | 65 | 2 | 70 | 2 | 18 | 1 |
| 11 | 11.9 | 2 | 25 | 2 | 25 | 2 | 9 | 1 |
| 12 | 11.9 | 2 | 17 | 2 | 17 | 2 | 6 | 1 |

| | Kerosene | | Diesel oil | | Pine camphor oil | |
|---|---|---|---|---|---|---|
| | amount ($g \cdot t^{-1}$) | mixing time (min) | amount ($g \cdot t^{-1}$) | mixing time (min) | amount ($g \cdot t^{-1}$) | mixing time (min) |
| 4 | 35 | 2 | — | — | 8 | 1 |
| 5 | 35 | 2 | — | — | 8 | 1 |
| 6 | 17 | 2 | — | — | 4 | 1 |
| 7 | 12 | 2 | — | — | 3 | 1 |

After the above flotation, copper concentrates (combining copper concentrate I and copper concentrate II) grading 21.28% Cu was obtained at recovery and yield of 89.79% and 3.97% respectively.

EXAMPLE 2

The operations were similar to those in example 1. The reagent amounts and mixing time of each operation are shown in Table 2 below.

TABLE 2

| Numerical order | CaO pH value | CaO mixing time (min) | CMC amount ($g \cdot t^{-1}$) | CMC mixing time (min) | Xanthate amount ($g \cdot t^{-1}$) | Xanthate mixing time (min) | Pine camphor oil amount ($g \cdot t^{-1}$) | Pine camphor oil mixing time (min) |
|---|---|---|---|---|---|---|---|---|
| 1 | 11.4 | 2 | 75 | 2 | 75 | 2 | 22 | 1 |
| 2 | 11.5 | 2 | 37 | 2 | 37 | 2 | 11 | 1 |
| 3 | 11.5 | 2 | 25 | 2 | 25 | 2 | 7 | 1 |
| 9 | 11.9 | 2 | 70 | 2 | 75 | 2 | 24 | 1 |
| 10 | 11.9 | 2 | 65 | 2 | 70 | 2 | 20 | 1 |
| 11 | 11.9 | 2 | 35 | 2 | 37 | 2 | 12 | 1 |
| 12 | 11.9 | 2 | 23 | 2 | 25 | 2 | 8 | 1 |
| | Kerosene | | Diesel oil | | Pine camphor oil | | — | — |
| | amount ($g \cdot t^{-1}$) | mixing time (min) | amount ($g \cdot t^{-1}$) | mixing time (min) | amount ($g \cdot t^{-1}$) | mixing time (min) | — | — |
| 4 | 40 | 2 | — | — | 10 | 1 | — | — |
| 5 | 40 | 2 | — | — | 8 | 1 | — | — |
| 6 | 20 | 2 | — | — | 5 | 1 | — | — |
| 7 | 13 | 2 | — | — | 3 | 1 | — | — |

After the flotation, copper concentrates (combining copper concentrate I and copper concentrate II) grading 21.12% Cu was obtained at recovery and yield of 91.3% and 3.89% respectively.

EXAMPLE 3

The operations were similar to those in example 1 with the exception that diesel oil was used as collector in the step (3) fine-grain flotation circuits.

The reagent amounts and mixing time of each operation are shown in Table 3 below.

TABLE 3

| Numerical order | CaO pH value | CaO mixing time (min) | CMC amount ($g \cdot t^{-1}$) | CMC mixing time (min) | Xanthate amount ($g \cdot t^{-1}$) | Xanthate mixing time (min) | Pine camphor oil amount ($g \cdot t^{-1}$) | Pine camphor oil mixing time (min) |
|---|---|---|---|---|---|---|---|---|
| 1 | 11.6 | 2 | 70 | 2 | 75 | 2 | 24 | 1 |
| 2 | 11.5 | 2 | 35 | 2 | 37 | 2 | 12 | 1 |
| 3 | 11.5 | 2 | 24 | 2 | 25 | 2 | 8 | 1 |
| 9 | 12.0 | 2 | 60 | 2 | 60 | 2 | 24 | 1 |
| 10 | 11.9 | 2 | 60 | 2 | 65 | 2 | 20 | 1 |
| 11 | 11.8 | 2 | 30 | 2 | 30 | 2 | 12 | 1 |
| 12 | 11.8 | 2 | 20 | 2 | 20 | 2 | 8 | 1 |
| | Kerosene | | Diesel oil | | Pine camphor oil | | | |
| | amount ($g \cdot t^{-1}$) | mixing time (min) | amount ($g \cdot t^{-1}$) | mixing time (min) | amount ($g \cdot t^{-1}$) | mixing time (min) | | |
| 4 | — | — | 38 | 2 | 9 | 1 | | |
| 5 | — | — | 38 | 2 | 9 | 1 | | |
| 6 | — | — | 19 | 2 | 4 | 1 | | |
| 7 | — | — | 12 | 2 | 3 | 1 | | |

After the flotation, copper concentrates (combining copper concentrate I and copper concentrate II) grading 21.03% Cu was obtained at recovery and yield of 90.42% and 4.12% respectively.

What is claimed is:

1. A beneficiation method for processing a chalcopyrite ore, the method comprising the following steps:

(1) grinding a crushed chalcopyrite ore to produce a first product, wherein 60% of the particles of the first product have a size of up to 0.074 mm; separating the first product into a first coarse fraction having particles with a size of greater than 0.4 mm and a first fine fraction having particles with a size of less than or equal to 0.4 mm; grinding the first coarse fraction to produce a second product, wherein 91% of the particles of the second product have a size of up to 0.074 mm; separating the second product by particle size into a second coarse fraction having particles with a size of greater than 0.4 mm and a second fine fraction having particles with a size of less than or equal to 0.4 mm;

(2) subjecting the second coarse fraction to a floatation process, the floatation process comprising:

subjecting the second coarse fraction to a rougher flotation to produce a rougher concentrate and rougher tailings, the rougher flotation comprising sequentially adding calcium oxide to adjust pH value, sodium carboxymethyl cellulose (CMC) as a depressor, xanthate as a collector, and pine camphor oil as a frother;

subjecting the rougher concentrate to a first cleaner flotation to produce a first cleaner concentrate and first cleaner tailings;

subjecting the first cleaner concentrate to a second cleaner flotation to produce a second cleaner concentrate and second cleaner tailings;

recycling the first cleaner tailings to the rougher flotation;

recycling the second cleaner tailings to the first cleaner flotation;

subjecting the rougher tailings to a first scavenger flotation to produce a first scavenger concentrate and first scavenger tailings, the first scavenger flotation comprising sequentially adding calcium oxide to adjust pH value, sodium carboxymethyl cellulose (CMC) as a depressor, xanthate as a collector, and pine camphor oil as a frother;

recycling the first scavenger concentrate to the rougher flotation;

subjecting the first scavenger tailings to a second scavenger flotation to produce a second scavenger concentrate and second scavenger tailings, the second scavenger flotation comprising sequentially adding calcium oxide to adjust pH value, sodium carboxymethyl cellulose (CMC) as a depressor, xanthate as a collector, and pine camphor oil as a frother;

recycling the second scavenger concentrate to the first scavenger flotation; and (3) subjecting the first and second fine fractions to a floatation process, the floatation process comprising:

subjecting the first and second fine fractions to a first rougher flotation to produce a first rougher concentrate and first rougher tailings, the first rougher flotation comprising sequentially adding kerosene or diesel as a collector and pine camphor oil as a frother;

subjecting the first rougher tailings to a second rougher flotation to produce a second rougher concentrate and second rougher tailings, the second rougher flotation comprising sequentially adding kerosene or diesel as a collector and pine camphor oil as a frother;

subjecting the second rougher tailings to a first scavenger flotation to produce a first scavenger concentrate and first scavenger tailings, the first scavenger flotation comprising sequentially adding kerosene or diesel as a collector and pine camphor oil as a frother;

recycling the first scavenger concentrate to the first rougher flotation;

subjecting the first scavenger tailings to a second scavenger flotation to produce a second scavenger concentrate and second scavenger tailings, the second scavenger flotation comprising sequentially adding kerosene or diesel as a collector and pine camphor oil as a frother;

subjecting the first rougher concentrate and the second rougher concentrate to a pre-cleaner flotation in absence of any reagents to produce a pre-cleaner concentrate and pre-cleaner tailings;

recycling the second scavenger concentrate and the pre-cleaner tailings to the first scavenger flotation;

subjecting the pre-cleaner concentrate to a first cleaning rougher flotation to produce a first cleaning rougher concentrate and first cleaning rougher tailings, the first cleaning rougher flotation comprising sequentially adding calcium oxide to adjust pH value, sodium carboxymethyl cellulose (CMC) as a depressor, xanthate as a collector, and pine camphor oil as a frother;

subjecting the first cleaning rougher tailings to a second cleaning rougher flotation to produce a second cleaning rougher concentrate and second cleaning rougher tailings, the second cleaning rougher flotation comprising sequentially adding calcium oxide to adjust pH value, sodium carboxymethyl cellulose (CMC) as a depressor, xanthate as a collector, and pine camphor oil as a frother;

subjecting the first cleaning rougher concentrate and the second cleaning rougher concentrate to a re-cleaner flotation to produce a re-cleaner concentrate and re-cleaner tailings;

recycling the re-cleaner tailings to the first cleaning rougher flotation;

subjecting the second cleaning rougher tailings to a first cleaning scavenger flotation to produce a first cleaning scavenger concentrate and first cleaning scavenger tailings, the first cleaning scavenger flotation comprising sequentially adding calcium oxide to adjust pH value, sodium carboxymethyl cellulose (CMC) as a depressor, xanthate as a collector, and pine camphor oil as a frother;

recycling the first cleaning scavenger concentrate to the second cleaning rougher flotation;

subjecting the first cleaning scavenger tailings to a second cleaning scavenger flotation to produce a second cleaning scavenger concentrate and second cleaning scavenger tailings, the second cleaning scavenger flotation comprising sequentially adding calcium oxide to adjust pH value, sodium carboxymethyl cellulose (CMC) as a depressor, xanthate as a collector, and pine camphor oil as a frother; and recycling the second cleaning scavenger concentrate to the first cleaning scavenger flotation.

2. The beneficiation method for processing a chalcopyrite ore according to claim 1, wherein in the step (2):

at the rougher flotation stage, the pH value is between 11.4 and 11.6, the amount of the depressor is between 65 and 75 $g \cdot t^{-1}$, the amount of the collector is between 60 and 90 $g \cdot t^{-1}$ and the amount of the frother is between 20 and 25 $g \cdot t^{-1}$;

at the first scavenger flotation stage, the pH value is between 11.4 and 11.6, the amounts of the depressor, the collector and the frother are half of those used at the rougher flotation stage respectively; and at the second scavenger flotation stage, the pH value is between 11.4 and 11.6, the amounts of the depressor, the collector and the frother are one third of those used at the rougher flotation stage respectively.

3. The beneficiation method for processing a chalcopyrite ore according to claim 1, wherein in the step (3):

at the first rougher flotation stage, the amount of the collector is between 35 and 40 $g \cdot t^{-1}$ and the amount of the frother is between 6 and 10 $g \cdot t^{-1}$;

at the second rougher flotation stage, the amounts of the collector and the frother are the same of those used at the first rougher flotation stage respectively at the first scavenger flotation stage, the amounts of the collector and the frother are half of those used at the first rougher flotation stage respectively; and at the second scavenger flotation stage, the amounts of the collector and the frother are one third of those used at the first rougher flotation stage respectively.

4. The beneficiation method for processing a chalcopyrite ore according to claim 1, wherein in the step (3):

at the first cleaning rougher flotation stage, the pH value is between 11.8 and 12.0, the amount of the depressor is between 50 and 70$g \cdot t^{-1}$, the amount of the collector is between 50 and 75$g \cdot t^{-1}$ and the amount of the frother is between 18 and 24 $g \cdot t^{-1}$;

at the second cleaning rougher flotation stage, the pH value is between 11.8 and 12.0, the amount of the depressor is between 50 and 70 $g \cdot t^{-1}$, the amount of the collector is between 50 and 75$g \cdot t^{-1}$ and the amount of the frother is between 18 and 24 $g \cdot t^{-1}$;

at the first cleaning scavenger flotation stage, the pH value is between 11.8 and 12.0, and the amounts of the depressor, the collector and the frother are half of those used at the first cleaning rougher flotation stage respectively; and at the second cleaning scavenger flotation stage, the pH value is between 11.8 and 12.0, and the amounts of the depressor, the collector and the frother are one third of those used at the first cleaning rougher flotation respectively.

* * * * *